United States Patent [19]

Rau

[11] 4,057,242

[45] Nov. 8, 1977

[54] PAPER MONEY CRIMPING APPARATUS

[76] Inventor: Allen E. Rau, 702 E. 49th St., Tacoma, Wash. 98404

[21] Appl. No.: 676,929

[22] Filed: Apr. 14, 1976

[51] Int. Cl.[2] ..... B65H 5/06

[52] U.S. Cl. ..... 271/3; 271/272; 29/121.1

[58] Field of Search ..... 271/3, 4, 272–274, 271/37, 223; 101/22; 226/193; 29/121.1, 121.2, 121.8; 425/335, 363, 366, 367, 385

[56] References Cited

U.S. PATENT DOCUMENTS

| | | | |
|---|---|---|---|
| 673,041 | 4/1901 | Ault | 425/363 |
| 2,273,476 | 2/1942 | Shaffer | 271/223 |
| 2,662,002 | 12/1953 | Sunderhauf et al. | 29/121.1 X |
| 3,226,111 | 12/1965 | Ellis | 271/272 |
| 3,612,513 | 10/1971 | Godlewski | 271/37 |
| 3,738,642 | 6/1973 | Blaire | 271/272 X |
| 3,788,638 | 1/1974 | Lehmann | 271/272 |
| 3,858,870 | 1/1975 | Yabe et al. | 271/272 |

*Primary Examiner*—Robert W. Saifer
*Attorney, Agent, or Firm*—Eugene D. Farley

[57] ABSTRACT

New paper money crimping apparatus comprises rotatably driven roll pairs through which the money is fed. One roll has a peripheral surface comprising resiliently deformable backup material while the other roll has a peripheral surface having a plurality of stiff embossing projections arranged in a selected pattern. The peripheral surfaces of the rolls are in pressure engagement with each other. Passage of the paper money between the rolls crimps or embosses it so that is becomes fluffed and separated and thereafter may be counted easily and accurately.

6 Claims, 2 Drawing Figures

PAPER MONEY CRIMPING APPARATUS

BACKGROUND OF THE INVENTION

This invention pertains to apparatus for crimping new paper money so that it may be separated and counted easily and accurately.

As is well known, new paper money is supplied to banks and other financial institutions in the form of bills which are stacked, firmly compressed, and bound. The use of such money is made difficult by the fact that it tends to stick together, both initially and when re-stacked, so that it cannot be counted and handled easily and accurately.

The problem is of particular importance with money to be used in serve-yourself cash machines now widely used in banks. This stick-together condition of the bills persists until the bills have lost their tendency to stick together through repeated handling and use.

Blaire U.S. Pat. No. 3,738,642 approaches the problem by proposing apparatus comprising interdigitated belts through which new money is passed for crimping. However, such apparatus is impractical because it is comparatively complex in construction, noisy in operation, and of relatively low capacity.

It accordingly is the principal object of the present invention to provide paper money crimping apparatus which will fluff and separate new paper money rapidly and effectively so that the money thereafter may be counted and handled with speed and accuracy.

It is a further object of the present invention to provide paper money crimping apparatus which is of high capacity, being capable of processing money in the form of bundles of as many as twenty five bills each, and which does not tear or curl the money as it is being processed.

Another object of the present invention is the provision of paper money crimping apparatus provided with means for guiding the money effectively through the apparatus so that it proceeds in a straight line flow to the apparatus discharge, without deviation and without dropping downwardly between the crimping elements.

A further object of the present invention is the provision of paper money crimping apparatus which is of simple, rugged construction, which is durable in operation, and which requires but little adjustment or maintenance throughout its service life.

Still a further object of the present invention is the provision of new paper money crimping apparatus which is safe and quiet in operation.

SUMMARY OF THE INVENTION

The foregoing and other objects of the invention are accomplished by the provision of paper money crimping apparatus which comprises at least one pair of parallel rolls arranged with their surfaces in peripheral pressure contact with each other. The rolls have embossing surfaces and are associated with infeed means for feeding new paper money between the rolls and with outfeed means for discharging the crimped paper money from between the rolls.

Preferably, the rolls are arranged in spaced pairs, one roll of each pair having a surface of resilient backup material such as sponge rubber and the other roll being of relatively stiff material such as cast aluminum. The latter roll has on its outer surface a plurality of integral embossing projections arranged in a selected pattern.

The roll surfaces are adjacent and in peripheral pressure engagement with each other, either per se or through the money being processed, so that money fed between them is passed to their discharge sides.

Roll mounting means mount the rolls rotatably, and drive means are connected to at least one of the rolls for driving it, as well as its associated roll, at a predetermined rotational speed.

DESCRIPTION OF A PREFERRED EMBODIMENT OF THE INVENTION

The invention is described herein with reference to the accompanying drawings, wherein.

Figure 2:
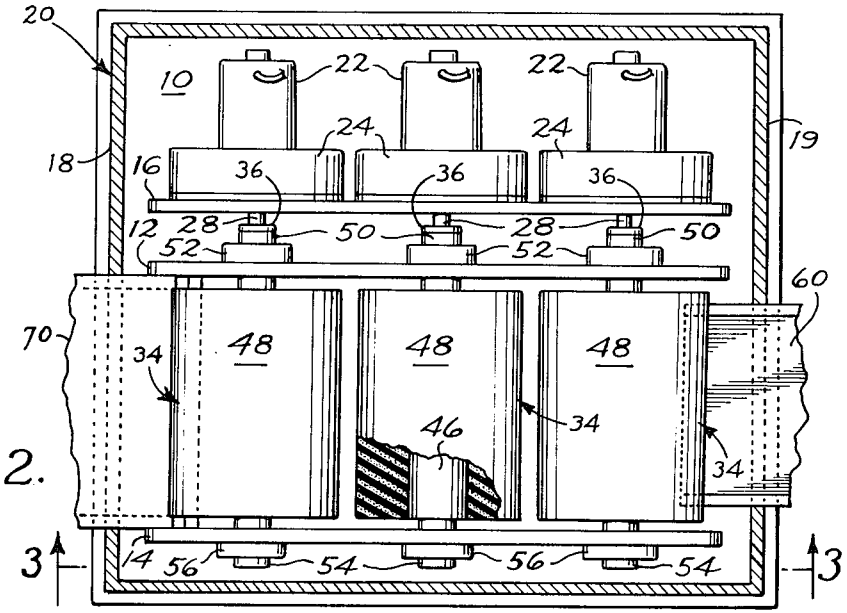
FIG. 2 is a fragmentary sectional view in plan, taken along line 2—2 of FIG. 1.

The apparatus is mounted on a base 10 provided with a pair of horizontally spaced upstanding standards 12, 14 and a horizontally spaced vertical motor mounting bracket 16.

Vertical end plates 18, 19 are included in a case 20 with removable lid 21 which houses the various elements of the apparatus.

In the described embodiment there are three horizontally spaced pairs of crimping or embossing rolls arranged along a lineal money travel path. For reasons of simplicity of construction and freedom from maintenance problems, these preferably are driven independently by three constant speed electric motors 22 with associated gear boxes 24. The latter are mounted on standard 16 and supported thereby in operative relation to the roll pairs.

Motors 22 are of the constant speed type which run synchronously at a speed of, for example, about 60 rpm. This is magnified by gear boxes 24 to a rotational speed of about 120 rpm. The motors are of the heavy duty type, sufficiently powerful to drive stacks of money through the apparatus at the desired lineal rate.

Figure 3:
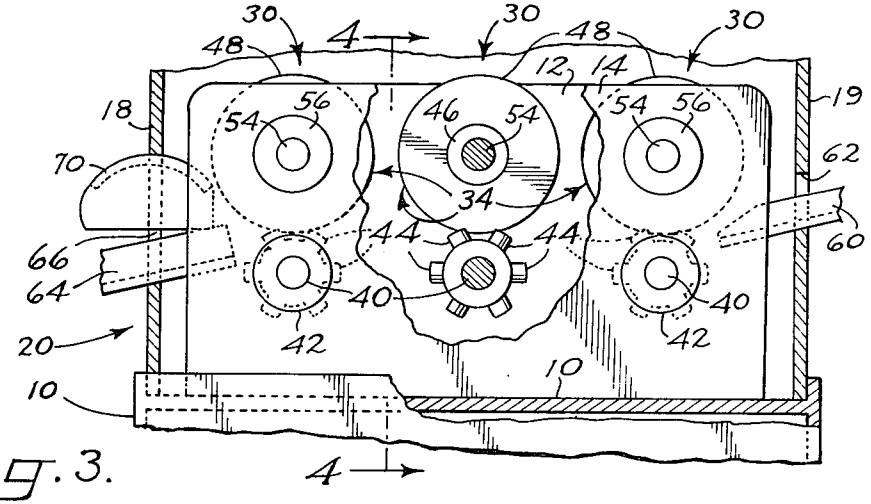
FIG. 3 is a fragmentary sectional view in side elevation, taken along line 3—3 of FIG. 2.

The gear box 24 of each motor is connected by a shaft 28 to one of the component rolls of roll pairs indicated generally at 30, FIG. 3.

The roll pairs are supported between standards 12, 14. Each roll pair comprises a drive roll 32 and a driven roll 34. These are arranged so that they are substantially parallel to each other with their surfaces adjacent and in peripheral pressure engagement with each other, either per se or through the work being processed.

Drive roll 32 preferably is made of cast aluminum or other hard, stiff material. It has on one end a hollow shaft 36 which receives shaft 28 of gear box 24. A set screw 38 releasably couples the two shafts.

The drive roll has on its other end an outwardly extending coaxial shaft 40 which is received in a bearing 42 mounted on the outer face of standard 14.

Extending radially outwardly from the surface of drive roll 32 are a plurality of button-shaped projections 44. These serve the dual functions of embossing or crimping the paper money as it passes through the apparatus, and of driving companion roll 34 with which roll 32 is associated in the roll pair.

Projections 44 may have any desired form and are arranged in any desired pattern. In the preferred and illustrated form of the invention, they are round in cross section and thus substantially cylindrical in form.

The companion roll 34 of each roll pair 30 comprises a core 46 made of metal, plastic, or other suitable structural material. The core mounts a covering 48 of a soft resilient material such as foamed rubber or plastic. The material employed should not only be resilient in character, it also should have good wear properties since it is subjected to considerable stress during the operation of the apparatus. Foamed natural or neoprene rubber are preferred materials.

The core 46 of roll 34 has extending outwardly from one end a coaxial shaft 50 which penetrates an opening through standard 12 and is mounted in a bearing 52 supported on the outer face of the latter.

The roll core has a companion coaxial shaft 54 extending outwardly from its other end. This shaft penetrates an opening in standard 14 and is journaled in a bearing 56 mounted on the outer face of the latter.

Figure 4:
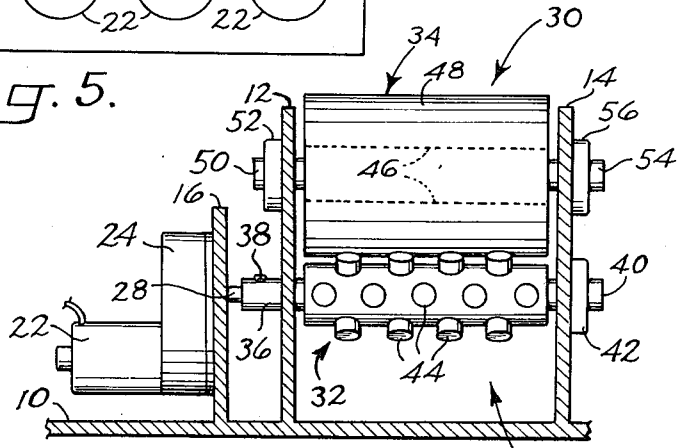
FIG. 4 is a fragmentary, transverse, sectional view taken along line 4—4 of FIG. 3.

As seen particularly in FIG. 4, the relationship between the two rolls is such that during operation the embossing or crimping projections 44 of drive roll 32 engage and depress resilient covering 48 of backup roll 34. The drive roll accordingly not only will crimp paper money passed between the two rolls; it also will drive the backup roll which accordingly will rotate together with the drive roll.

Feed means is provided for feeding between the rolls new paper money as single bills or in bundles.

Figure 1:
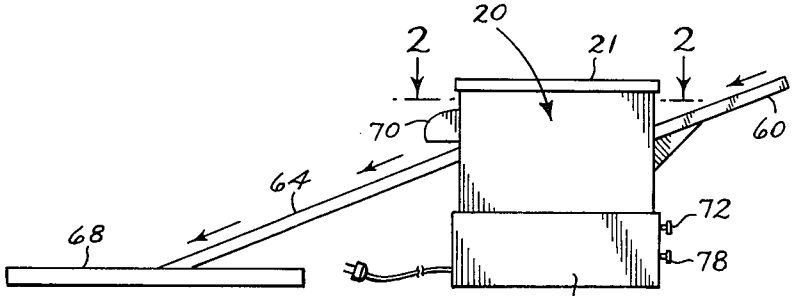
FIG. 1 is a view in side elevation of the paper money crimping apparatus of my invention.

As shown particularly in FIGS. 1 and 2, the feed means comprises a chute 60 extending through a hole 62 in one end wall 19 of the case. The chute is supported and angled to deliver the money directly between the first pair 30 of crimping rolls.

Means also are provided for discharging the crimped money from the apparatus.

Such means comprise a second chute 64 which passes through an opening 66 in end wall 18 of the case, by which end wall the chute is supported.

Chute 64 is suitably angled. Its upstream end is positioned adjacent the discharge side of the last of roll pairs 30 for receiving the bills discharged by the roll pair. Its downstream end delivers the crimped money to a collection tray 68.

Guide or deflector means is associated with the discharge chute for deflecting money onto the latter as it is discharged at a considerable rate from the machine.

The deflector means comprises a hood 70, FIG. 3, supported on end wall 18 just above the upstream end of chute 64. Any money which tends to fly upwardly as it is discharged from the terminal roll pair is deflected by the inner surface of the hood and guided thereby downwardly onto chute 64 and thence into collection tray 68.

Figure 5:
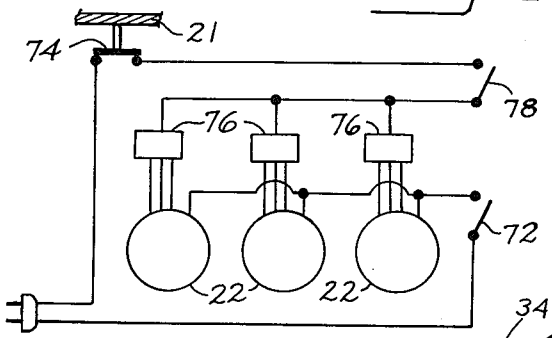
FIG. 5 is a schematic wiring diagram of an electric circuit which may be employed in the apparatus.

The electric circuit for the apparatus drive is illustrated schematically in FIG. 5.

Current from the house line passes through each of the motors, driving them independently. The circuit includes on-off switch 72, safety switch 74, and heat-sensitive on-off switched operated by associated relays 76 with relay reset 78.

Safety switch 74 is positioned so that it is closed (and the circuit made) when lid 21 is seated on case 20. Removal of the lid opens the switch, breaks the circuit and stops the drive. This insures that the operator cannot get his hand caught between the rolls.

The three relays act to cut out the motors if any one of the latter should overheat, thereby eliminating the possibility of scorching the money as it passes through the apparatus.

In operation, new paper money in stacks of from 1–25 bills is fed into the apparatus through infeed chute 60. It passes into the nip of the first set of embossing rolls 30 and is thereafter transferred from roll pair to roll pair along the operative length of the apparatus. This is made possible by the fact that the spacing between the roll pairs is less than the length of the bills. As a result, the bills traverse the apparatus uniformly, without deviating from their course and in particular without gravitating to the bottom of the case through the spaces between the roll pairs.

As the bills pass between the component rolls of each roll pair, embossing drive rolls 32 press the substance of the bills into the soft resilient covering of backup rolls 34. This embosses the money with a pattern determined by the shape of projections 44 on the drive rolls.

The rolls turn at a speed of, for example, 120 rpm. Accordingly, the money passes through the apparatus at a considerable rate. At the outfeed end, it is deflected by hood 70 onto outfeed chute 64 which in turn transfers it to collection trays 68.

The apparatus thus operates to crimp the bills, in effect separating them without fluffing them excessively, so that the individual bills leaving the apparatus may be counted, handled, and stacked effectively and accurately. This all is accomplished at a substantial speed. In a typical instance two operators, one feeding and one receiving, can in 45 minutes time crimp as much as $40,000.00 in $20.00 bills.

Having thus described my invention in preferred embodiments, I claim:

1. New paper money crimping apparatus comprising:

a. a plurality of pairs of parallel rolls arranged along a linear money travel path, adjacent pairs being spaced from each other in the feed direction by a distance of less than the length of the money to be crimped for transferring the same from one pair to the next, b. the rolls of each pair being arranged with their surfaces in peripheral pressure engagement with each other, c. one roll of each pair having a peripheral surface of resiliently deformable sponge rubber, d. the other roll of each pair being of relatively stiff material and provided with a plurality of embossing projections arranged in a selected pattern, e. the rolls being adapted to receive flatwise paper money to be crimped between their engaging surfaces and for passing it from one roll pair to the next, f. infeed chute means positioned for feeding fresh paper money to the first pair of rolls, g. outfeed chute means positioned for discharging crimped paper money from the last pair of rolls, h. guide means associated with the outfeed chute means for guiding crimped paper money onto the same, i. roll mounting means rotatably mounting the rolls, and j. electric motor drive means connected to the rolls for driving the same at a predetermined rotational speed.

2. New paper money crimping apparatus comprising:

a. a plurality of pairs of parallel rolls arranged along a linear money travel path, adjacent pairs being spaced from each other in the feed direction by a distance of less than the length of the money to be crimped for transferring the same from one pair to the next, b. roll mounting means rotatably mounting the rolls, c. the rolls of each pair being arranged with their surfaces in peripheral pressure engagement with each other, d. one roll of each pair having a peripheral surface of resiliently deformable backup material, e. the other roll of each pair having on its peripheral surface a plurality of relatively stiff embossing projections arranged in a selected pattern, f. the roll of each pair being adapted to receive flatwise paper money to be crimped between their engaging surfaces and for passing it from one roll pair to the next, g. infeed means for feeding fresh paper money to the first pair of rolls, h. outfeed means for discharging crimped paper money from the last pair of rolls, and i. drive means connected to the rolls for driving the same at a predetermined rotational speed, j. the drive means comprising a constant speed electric motor for each pair of rolls, the motors being operated at substantially the same speed.

3. The apparatus of claim 2 including an electric supply circuit for the electric motors, and temperature sensitive switch means in said electric supply circuit responsive to a predetermined elevated temperature in the proximity of the motors and rolls to deactivate the motors.

4. The apparatus of claim 2 wherein the infeed means comprises an infeed chute positioned for feeding fresh paper money to the first pair of rolls.

5. The apparatus of claim 2 wherein the outfeed means comprises an outfeed chute positioned for discharging crimped paper money from the last pair of rolls.

6. The apparatus of claim 5 including guide means associated with the outfeed chute for guiding crimped paper money onto the same.

* * * * *